US010962221B2

(12) United States Patent
Wu

(10) Patent No.: US 10,962,221 B2
(45) Date of Patent: Mar. 30, 2021

(54) FLAME GUN WITH FLOW CONTROL RING

(71) Applicant: Pro-Iroda Industries, Inc., Taichung (TW)

(72) Inventor: Wei Cheng Wu, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 195 days.

(21) Appl. No.: 16/234,695

(22) Filed: Dec. 28, 2018

(65) Prior Publication Data

US 2020/0149739 A1 May 14, 2020

(30) Foreign Application Priority Data

Nov. 13, 2018 (TW) ..... 107140148

(51) Int. Cl.
*F23D 14/38* (2006.01)
*F23D 11/00* (2006.01)

(52) U.S. Cl.
CPC ..... *F23D 11/001* (2013.01); *F23D 14/38* (2013.01)

(58) Field of Classification Search
CPC ..... F23D 11/001; F23D 14/34; F23D 14/38; F23D 14/465
See application file for complete search history.

(56) References Cited

U.S. PATENT DOCUMENTS 3,994,674 A 11/1976 Baumann et al.
4,938,686 A * 7/1990 Yoshinaga ..... F23D 14/28 431/264
5,215,458 A 6/1993 Cirami
5,564,918 A * 10/1996 Lin ..... F23D 14/28 431/255
5,564,919 A * 10/1996 Tsai ..... F23D 14/28 431/255
6,932,596 B2 * 8/2005 Watanabe ..... F23D 14/28 431/153
7,566,219 B2 7/2009 Lin
7,850,446 B2 12/2010 Tsai
9,322,270 B2 4/2016 Baumgartner
9,879,856 B2 1/2018 Tsai
(Continued)

FOREIGN PATENT DOCUMENTS

CN 1439823 A 9/2003
CN 201358976 Y 12/2009
CN 201593537 U 9/2010
(Continued)

*Primary Examiner* — Alfred Basichas
(74) *Attorney, Agent, or Firm* — Alan D. Kamrath; Karin L. Williams; Mayer & Williams PC

(57) ABSTRACT

A flame gun with a flow control ring includes a body with a gas outlet assembly disposed therein. The gas outlet assembly includes a flow regulator being rotatable about an axis. A flow controller is coupled to and operably rotatable relative to the body. The flow controller is configured to drive the flow regulator rotationally and includes a connecting portion connected to the flow regulator. The flow controller includes an input portion disposed in a spaced relationship with the connecting portion and includes at least one link arm interconnecting and extending between the connecting portion and the input portion. The input portion is disposed circumferentially and surrounds at least half an outer periphery of the body.

17 Claims, 5 Drawing Sheets

(56) References Cited

U.S. PATENT DOCUMENTS

2005/0166977 A1* 8/2005 Gregory ..... B62J 37/00
137/625.41

FOREIGN PATENT DOCUMENTS

| | | | |
|---|---|---|---|
| CN | 201636116 | U | 11/2010 |
| CN | 201636117 | U | 11/2010 |
| CN | 201636118 | U | 11/2010 |
| CN | 102434523 | A | 5/2012 |
| CN | 202560686 | U | 11/2012 |
| CN | 203146475 | U | 8/2013 |
| CN | 103438050 | A | 12/2013 |
| CN | 203321937 | U | 12/2013 |
| CN | 203335528 | U | 12/2013 |
| CN | 203376549 | U | 1/2014 |
| CN | 203500175 | U | 3/2014 |
| CN | 203500176 | U | 3/2014 |
| CN | 203548411 | U | 4/2014 |
| CN | 203614510 | U | 5/2014 |
| CN | 203627378 | U | 6/2014 |
| CN | 104074837 | A | 10/2014 |
| CN | 203926221 | U | 11/2014 |
| CN | 104389850 | A | 3/2015 |
| CN | 204239375 | U | 4/2015 |
| CN | 104595281 | A | 5/2015 |
| CN | 204434219 | U | 7/2015 |
| CN | 204739033 | U | 11/2015 |
| DE | 19905855 | A1 | 8/2000 |
| JP | 2002227906 | A | 8/2002 |
| TW | D121085 | S | 1/2008 |
| TW | M365452 | U | 9/2009 |
| TW | M531541 | U | 11/2016 |

* cited by examiner

FLAME GUN WITH FLOW CONTROL RING

BACKGROUND OF THE INVENTION

1. Field of the Invention

The present invention relates to a flame gun and, particularly, to a flame gun with a flow control ring.

2. Description of the Related Art

TW Pat. No. D121085 shows a flame gun. The utility model includes an elliptic cylindrical shaped gas storage reservoir, which has an end surface integrally formed on a control seat, and a lower end surface connected to a base and extending smoothly and curvedly. The front surface of the gas storage reservoir, which is of a material different from that of the body, has a quadrangular outer edge. The quadrilateral edge extends symmetrically to both sides of the gas storage cylinder. A plurality of separated shallow grooves extends from symmetric arc sides of the quadrilateral edge to a back of the gas storage cylinder. A narrow arc extends parallel to a corner of the quadrilateral edge and is located on one side of the gas storage cylinder. The control seat has an upwardly rising end and a rear cover similar to a lamp cover. The rear cover is laterally intersected with the end. The rear cover has an end including a round button. A safety switch is disposed below the button. The end has a surface which is adjacent to a port and includes a plurality of arc shaped venting ports arranged symmetrically. An end surface is provided with a push button for controlling the air intake amount and another surface is provided with a knob for adjusting the gas flow rate. The push button and the knob are disposed on symmetrical sides.

Generally, a user holds the flame gun with the one hand. In particular, with the right hand, as the right handed people are dominant worldwide. However, when the right hand is used to hold the flame gun, it is difficult to touch the knob with the index finger or thumb of the right hand. Thus, it is impossible to adjust the gas flow with one hand. Even if the flame gun is held by the left hand, the knob can only be adjusted through the left thumb.

The present invention is, therefore, intended to obviate or at least alleviate the problems encountered in the prior art.

SUMMARY OF THE INVENTION

According to the present invention, a flame gun with a flow control ring includes a body with a gas outlet assembly disposed therein. The gas outlet assembly includes a flow regulator being rotatable about an axis. A flow controller is coupled to and operably rotatable relative to the body. The flow controller is configured to drive the flow regulator rotationally and includes a connecting portion connected to the flow regulator. The flow controller includes an input portion disposed in a spaced relationship with the connecting portion and includes at least one link arm interconnecting and extending between the connecting portion and the input portion. The input portion is disposed circumferentially and surrounds at least half an outer periphery of the body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
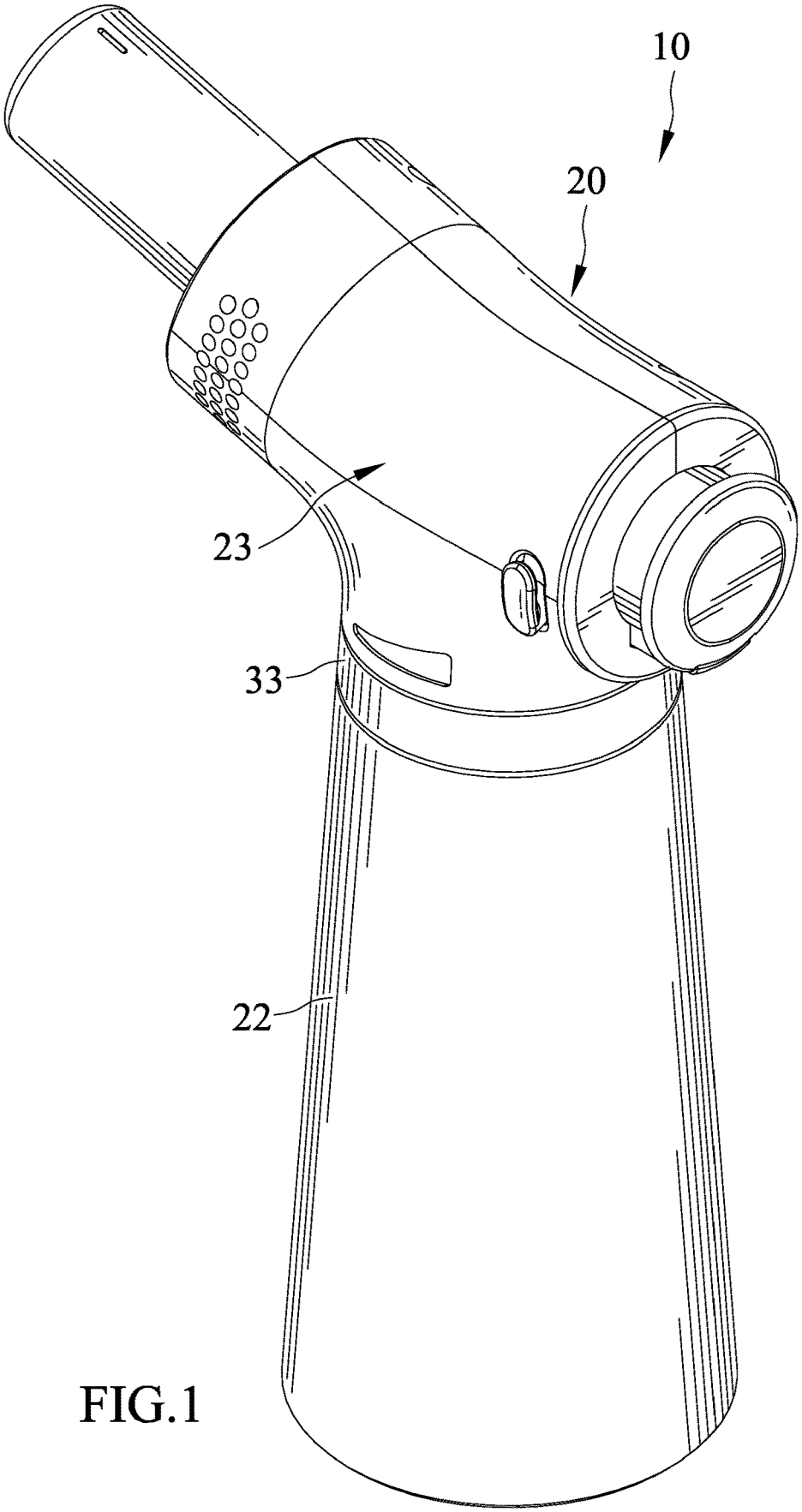
FIG. 1 is a perspective view of a flame gun with flow control in accordance with the present invention.
Figure 2:
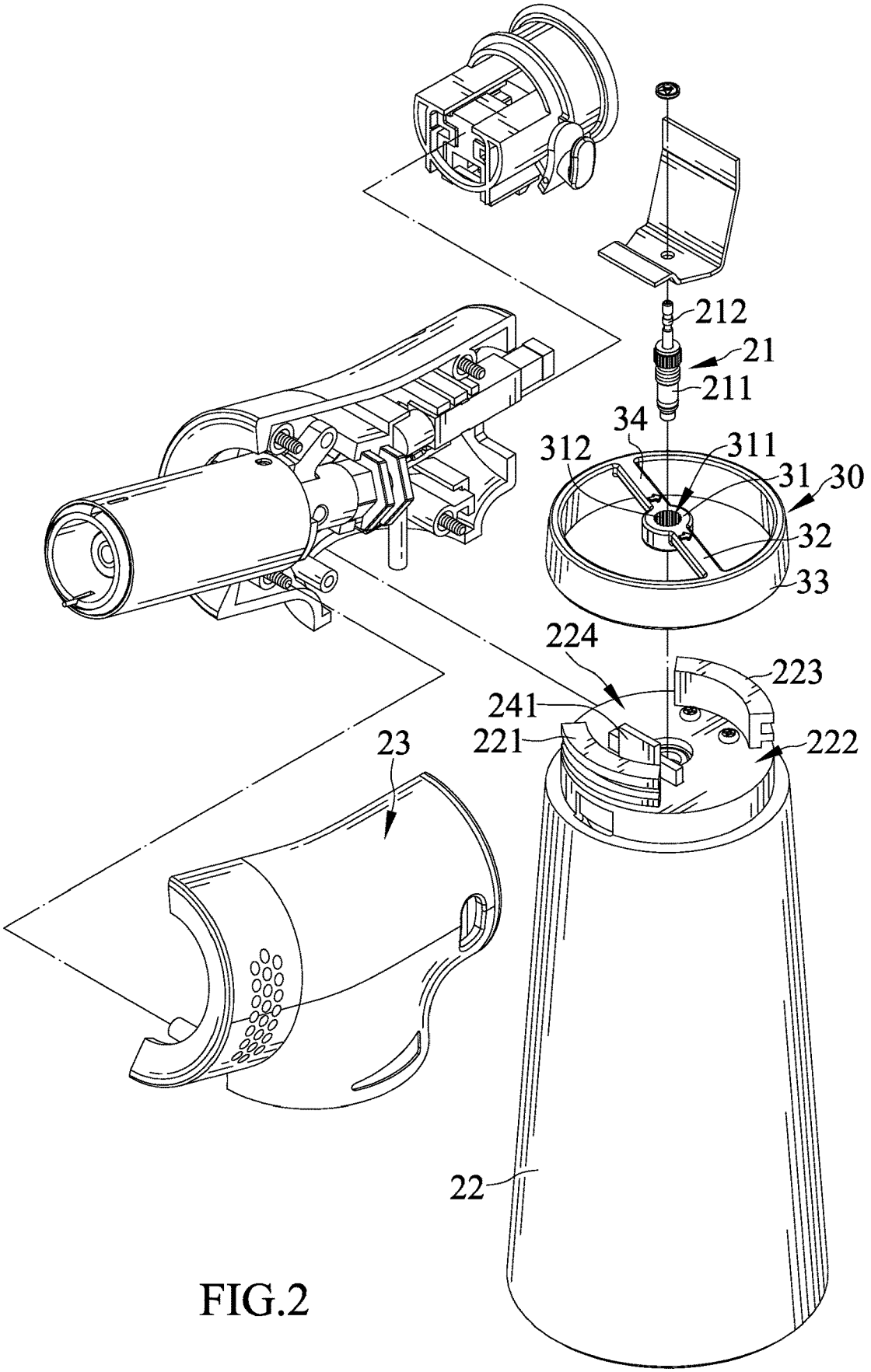
FIG. 2 is an exploded perspective view of the flame gun of FIG. 1.
Figure 3:
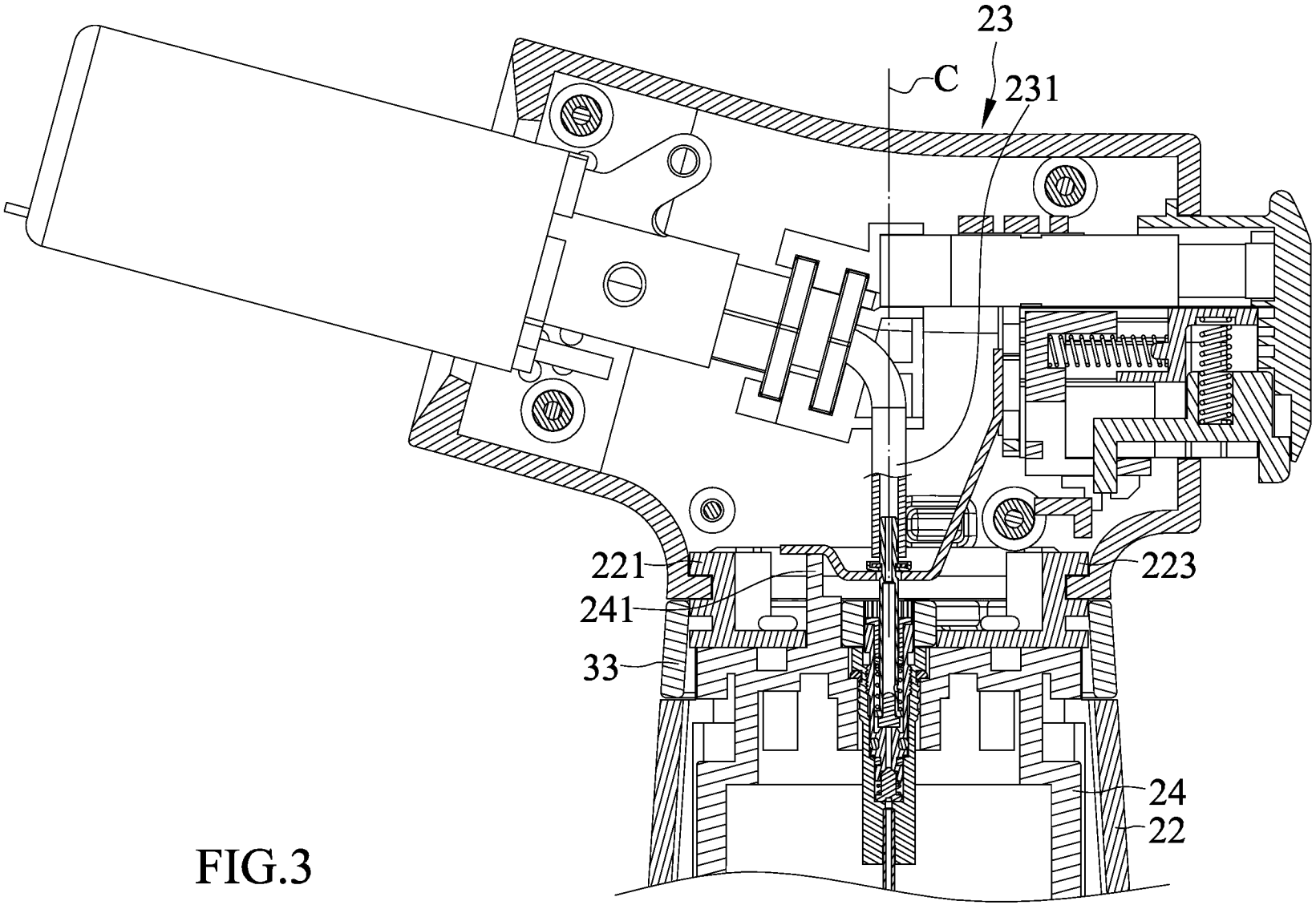
FIG. 3 is a cross-sectional view of the flame gun of FIG. 1.
Figure 4:
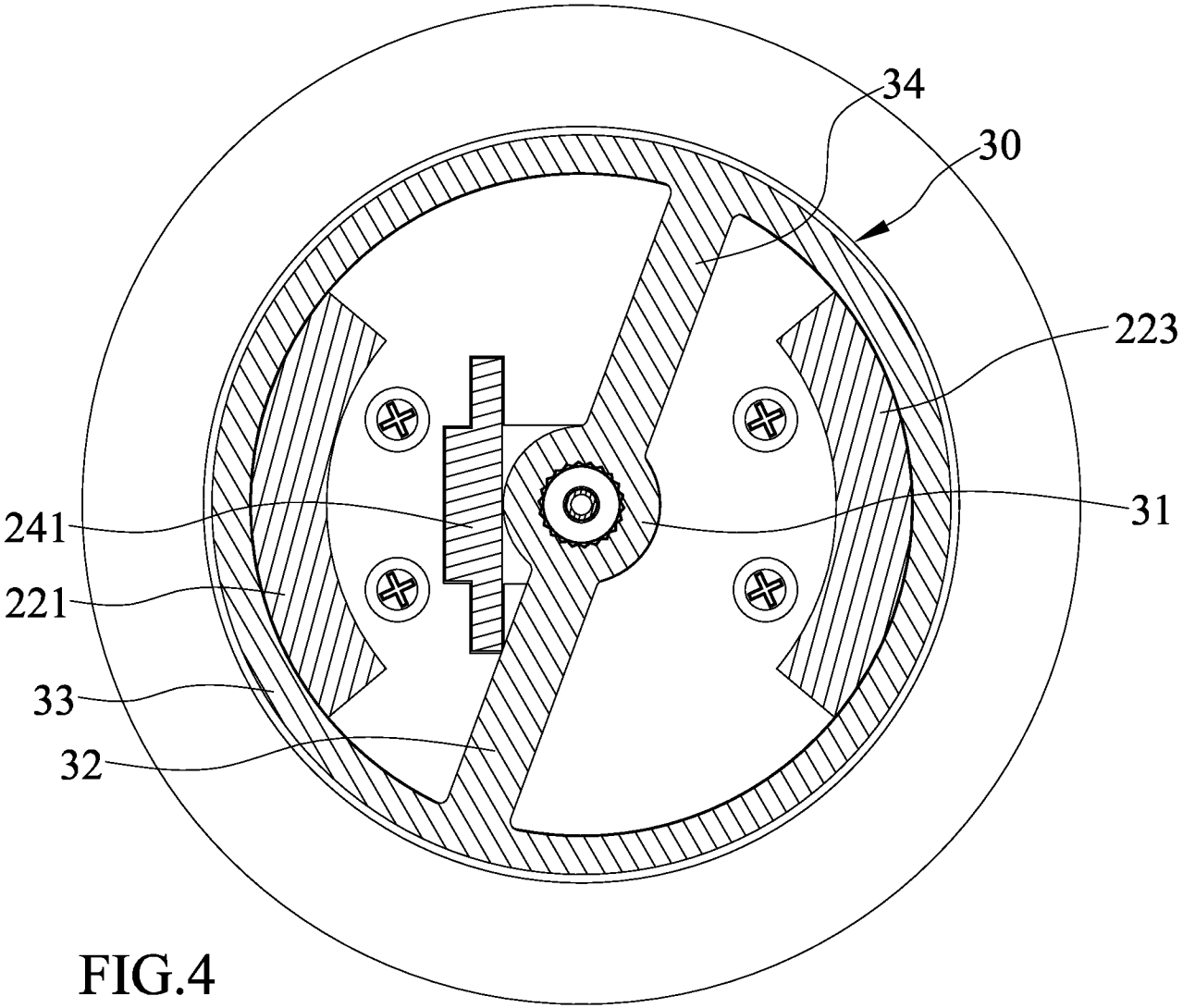
FIG. 4 is a cross-sectional view illustrating the flame gun of FIG. 1 subject to a first flow control setting.
Figure 5:
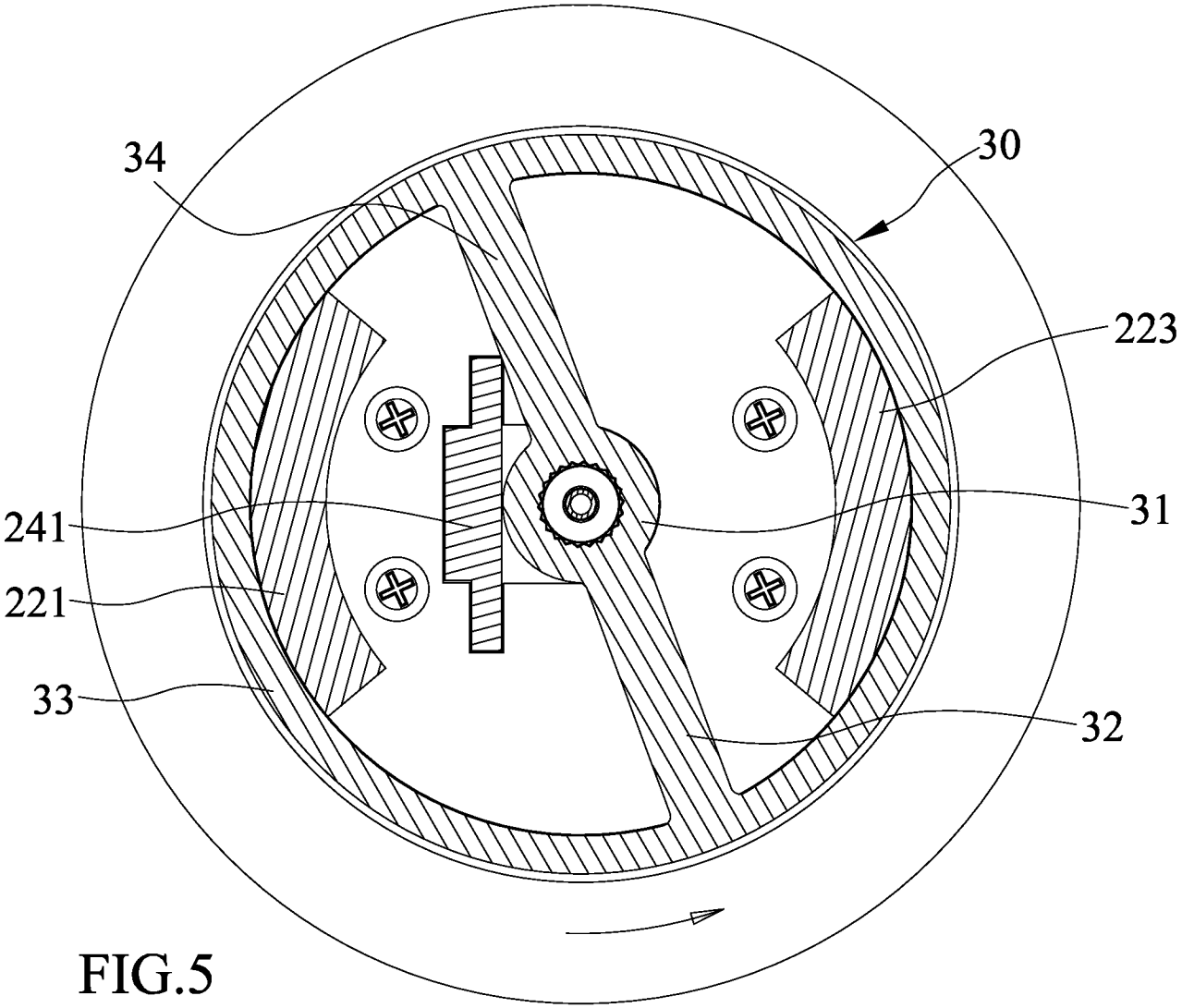
FIG. 5 is a cross-sectional view illustrating the flame gun of FIG. 1 subject to a second flow control setting.

FIGS. 1 through 5 show a flame gun 10 with a flow control ring in accordance with the present invention.

The flame gun 10 includes a body 20 including a gas outlet assembly 21 disposed therein. The gas outlet assembly 21 includes a flow regulator 211 being rotatable about an axis C. The flow regulator 211 is in thread engagement with the body 20. The body 20 includes a grip portion 22 and a flame head portion 23, wherein the grip portion 22 includes a fuel canister 24 disposed therein. The gas outlet assembly 21 has a first end connected to and in fluid communication with the fuel canister 24 and a second end connected to and in fluid communication with a fuel passage 231 of the flame head portion 23. The flow regulator 211 is disposed and movable to adjust the size of an opening between the fuel passage 231 and the fuel canister 24. The body 20 includes a first connecting structure 221 and a first receiving structure 222 adjacent to each other and arranged along the outer periphery of the body 20. The body 20 includes a second connecting structure 223 and a second receiving structure 224 adjacent to each other and arranged along the outer periphery of the body 20. The first receiving structure 222 is disposed between first ends of the first and second connecting structures 221 and 223 and the second receiving structure 224 is disposed between second ends of the first and second connecting structures 221 and 223 respectively. The body 20 includes a positioning structure 241 disposed between the first and second connecting structures 221 and 223.

Further, the flame gun 10 includes a flow controller 30 coupled to and operably rotatable relative to the body 20. The flow controller 30 is engaged with and rotatable relative to the first connecting structure 221 and includes a peripheral section disposed in the first receiving structure 222. The flow controller 30 is engaged with and rotatable relative to the second connecting structure 223 and includes another peripheral section disposed in the second receiving structure 224. The flow controller 30 is configured to drive the flow regulator 211 rotationally. The flow controller 30 includes a connecting portion 31 connected to the flow regulator 211. The flow regulator 211 is connected to the flow controller 30 with no relative rotation therebetween. The flow regulator 211 has a first engaging structure 212 including first ridges and a first recess between two adjacent first ridges. The connecting portion 31 has a second engaging structure 312 including second ridges and a second recess between adjacent two adjacent second ridges and one of the first ridges is disposed between the two adjacent second ridges and engaged in the second recess. The second engaging structure 312 is formed on a periphery of a hole 311 defined by the connecting portion 31.

The flow controller 30 includes an input portion 33 disposed in a spaced relationship with the connecting portion 31 and includes at least one link arm 32 and 34 interconnecting and extending between the connecting portion 31 and the input portion 33. The input portion 33 is disposed circumferentially and surrounds at least half an outer periphery of the body 20. The outer periphery of the body 20 has an annular periphery on which the input portion 33 completely surrounds and is disposed. The at least one link aim 32 and 34 includes a first link arm 32 and a second link aim 34. The first and second link arms 32 and 34 are disposed oppositely diametrically.

The first and second link arms 32 and 34 have ends that are movable in the first and second receiving structures 222 and 224 respectively upon rotation of the flow controller 30 relative to the body 20. The flow controller 30 is rotatable relative to the body 20 between a first position in which the positioning structure 241 is abutted against the first link arm 32 and disposed away from the second link arm 34, and a second position in which the positioning structure 241 is disposed away from the first link arm 32 and abutted against the second link arm 34.

In view of the forgoing, the user can easily rotate the flow controller 30 through the above structure. Since the input portion 33 surrounds the body 20, when the user holds the grip portion 22, the flow controller 30 can be operated by the index finger or the thumb and will not restrain the posture and angle of the hand during the adjustment operations. In particular, the flow controller 30 is applicable to both right and left hands, and the same effect can be achieved for all users.

The foregoing is merely illustrative of the principles of this invention and various modifications can be made by those skilled in the art without departing from the scope and spirit of the invention.

What is claimed is:

1. A flame gun with a flow control ring comprising:

a body having a grip portion and a flame head portion and including a gas outlet assembly disposed therein with a first end connected to and in fluid communication with a fuel canister and a second end connected to and in fluid communication with a passage of the flame head portion, and wherein the gas outlet assembly includes a flow regulator being rotatable about an axis to adjust the size of an opening between the fuel passage and the fuel canister; and a flow controller coupled to and operably rotatable relative to the body, wherein the flow controller is configured to drive the flow regulator rotationally and includes a connecting portion connected to the flow regulator, wherein the flow controller includes an input portion disposed in a spaced relationship with the connecting portion and includes at least one link arm interconnecting and extending between the connecting portion and the input portion, and wherein the input portion is disposed circumferentially and surrounds at least half an outer periphery of the body, wherein the input portion and the grip portion are arranged along the axis.

2. The flame gun as claimed in claim 1, wherein the outer periphery of the body has an annular periphery on which the input portion completely surrounds and is disposed.

3. The flame gun as claimed in claim 1, wherein the flow regulator is connected to the flow controller with no relative rotation therebetween.

4. The flame gun as claimed in claim 3, wherein the flow regulator is in thread engagement with the body.

5. The flame gun as claimed in claim 4, wherein the grip portion includes a fuel canister disposed therein.

6. The flame gun as claimed in claim 1, wherein the body includes a first connecting structure and a first receiving structure adjacent to each other and arranged along the outer periphery of the body, wherein the flow controller is engaged with and rotatable relative to the first connecting structure and includes a peripheral section disposed in the first receiving structure.

7. A flame gun with a flow control ring comprising:

a body including a gas outlet assembly disposed therein and the gas outlet assembly including a flow regulator being rotatable about an axis; and a flow controller coupled to and operably rotatable relative to the body, wherein the flow controller is configured to drive the flow regulator rotationally and includes a connecting portion connected to the flow regulator, wherein the flow regulator is connected to the flow controller with no relative rotation therebetween, wherein the flow controller includes an input portion disposed in a spaced relationship with the connecting portion and includes at least one link arm interconnecting and extending between the connecting portion and the input portion, wherein the input portion is disposed circumferentially and surrounds at least half an outer periphery of the body;

wherein the flow regulator has a first engaging structure including first ridges and a first recess between two adjacent first ridges, and wherein the connecting portion of the flow controller has a second engaging structure including second ridges and a second recess between adjacent two adjacent second ridges and one of the first ridges is disposed between the two adjacent second ridges and engaged in the second recess.

8. The flame gun as claimed in claim 7, wherein the body includes a first connecting structure and a first receiving structure adjacent to each other and arranged along the outer periphery of the body, wherein the flow controller is engaged with and rotatable relative to the first connecting structure and includes a peripheral section disposed in the first receiving structure.

9. The flame gun as claimed in claim 8, wherein the body includes a second connecting structure and a second receiving structure adjacent to each other and arranged along the outer periphery of the body, wherein the flow controller is engaged with and rotatable relative to the second connecting structure and includes another peripheral section disposed in the second receiving structure, wherein the first receiving structure is disposed between first ends of the first and second connecting structures and the second receiving structure is disposed between second ends of the first and second connecting structures respectively, and wherein the at least one link arm includes first and second link arms with ends movable in the first and second receiving structures respectively upon rotation of the flow controller relative to the body.

10. The flame gun as claimed in claim 9, wherein the body includes a positioning structure disposed between the first and second connecting structures, and wherein the flow controller is rotatable relative to the body between a first position in which the positioning structure is abutted against the first link arm and disposed away from the second link arm, and a second position in which the positioning structure is disposed away from the first link arm and abutted against the second link arm.

11. A flame gun with a flow control ring comprising:

a body including a gas outlet assembly disposed therein and the gas outlet assembly including a flow regulator being rotatable about an axis; and a flow controller coupled to and operably rotatable relative to the body, wherein the flow controller is configured to drive the flow regulator rotationally and includes a connecting portion connected to the flow regulator, wherein the flow controller includes an input portion disposed in a spaced relationship with the connecting portion and includes at least one link arm interconnecting and extending between the connecting portion and the input portion, and wherein the input portion is disposed circumferentially and surrounds at least half an outer periphery of the body, wherein the body includes a first connecting structure and a first receiving structure adjacent to each other and arranged along the outer periphery of the body, and wherein the flow controller is engaged with and rotatable relative to the first connecting structure and includes a peripheral section disposed in the first receiving structure, wherein the body includes a second connecting structure and a second receiving structure adjacent to each other and arranged along the outer periphery of the body, wherein the flow controller is engaged with and rotatable relative to the second connecting structure and includes another peripheral section disposed in the second receiving structure, wherein the first receiving structure is disposed between first ends of the first and second connecting structures and the second receiving structure is disposed between second ends of the first and second connecting structures respectively, and wherein the at least one link arm includes first and second link arms with ends movable in the first and second receiving structures respectively upon rotation of the flow controller relative to the body.

12. The flame gun as claimed in claim 11, wherein the body includes a positioning structure disposed between the first and second connecting structures, and wherein the flow controller is rotatable relative to the body between a first position in which the positioning structure is abutted against the first link arm and disposed away from the second link arm, and a second position in which the positioning structure is disposed away from the first link arm and abutted against the second link arm.

13. The flame gun as claimed in claim 12, wherein the first and second link arms are disposed oppositely diametrically.

14. The flame gun as claimed in claim 11, wherein the first and second link arms are disposed oppositely diametrically.

15. The flame gun as claimed in claim 11, wherein the body includes a first connecting structure and a first receiving structure adjacent to each other and arranged along the outer periphery of the body, wherein the flow controller is engaged with and rotatable relative to the first connecting structure and includes a peripheral section disposed in the first receiving structure.

16. The flame gun as claimed in claim 15, wherein the body includes a second connecting structure and a second receiving structure adjacent to each other and arranged along the outer periphery of the body, wherein the flow controller is engaged with and rotatable relative to the second connecting structure and includes another peripheral section disposed in the second receiving structure, wherein the first receiving structure is disposed between first ends of the first and second connecting structures and the second receiving structure is disposed between second ends of the first and second connecting structures respectively, and wherein the at least one link arm includes first and second link arms with ends movable in the first and second receiving structures respectively upon rotation of the flow controller relative to the body.

17. The flame gun as claimed in claim 16, wherein the body includes a positioning structure disposed between the first and second connecting structures, and wherein the flow controller is rotatable relative to the body between a first position in which the positioning structure is abutted against the first link arm and disposed away from the second link arm, and a second position in which the positioning structure is disposed away from the first link arm and abutted against the second link arm.

* * * * *